US005370367A

United States Patent [19]

Zaguroli, Jr.

[11] Patent Number: 5,370,367

[45] Date of Patent: Dec. 6, 1994

[54] SAFETY DEVICE FOR AN AIR BALANCING HOIST

[76] Inventor: James Zaguroli, Jr., 3080 Loon Lake Shores, Drayton Plains, Mich. 48020

[21] Appl. No.: 30,768

[22] Filed: Mar. 12, 1993

[51] Int. Cl.[5] ..... B66D 1/10; F01B 3/00

[52] U.S. Cl. ..... 254/360; 254/383; 92/31; 92/85 B

[58] Field of Search ..... 254/360, 383, 267; 92/31, 85 B

[56] References Cited

U.S. PATENT DOCUMENTS

| | | | |
|---|---|---|---|
| 3,160,360 | 12/1964 | Spieldiener et al. | 254/392 X |
| 3,260,508 | 7/1966 | Powell | 254/360 X |
| 3,311,351 | 3/1967 | Blakely | 254/392 X |
| 3,368,796 | 2/1968 | Ulbing | 254/267 |
| 3,428,298 | 2/1969 | Powell | 254/331 |
| 3,526,388 | 9/1970 | Geiger et al. | 254/360 |
| 4,210,064 | 7/1980 | Beerens | 92/85 B X |
| 4,566,375 | 1/1986 | van der Schoot | 99/348 |
| 4,625,933 | 12/1986 | Luciano et al. | 254/377 X |
| 4,722,422 | 2/1988 | Hiraoka | 254/377 X |

*Primary Examiner*—Daniel P. Stodola
*Assistant Examiner*—Michael R. Mansen
*Attorney, Agent, or Firm*—John R. Benefiel

[57] ABSTRACT

A safety device for an air balancing hoist includes one or more piston and cylinder shock absorbers engaged by one end of the drum ball nut, which creates a substantial retarding force at high speed but does not generate significant impeding forces at low speeds.

9 Claims, 2 Drawing Sheets

SAFETY DEVICE FOR AN AIR BALANCING HOIST

BACKGROUND OF THE INVENTION

This invention concerns an air balancing hoist in which regulated air pressure is applied to a movable element such as a diaphragm or piston to exert an axial force on a drum reel, which is in turn fixed to a ball screw or nut which results in a wind-up torque countering the wind out torque created by a load supported on a cable wound on the drum reel. The regulated air pressure is typically set at a level to counter all but a small proportion of the weight of the load, so that the load may be easily handled normally.

Such hoists are shown in U.S. Pat. Nos. 3,260,508, 3,428,298; and 3,526,388.

A safety hazard is inherent in these designs in that if the load is suddenly lost, as by the cable snapping, the regulated air pressure will cause the drum reel to rapidly wind up, with the end of the cable being swung wildly about.

Attempts have been made to prevent this from happening by automatically reducing the applied air pressure in this event, but rapid rotation of the drum reel has usually been already started such that its momentum continues the too fast cable wind up.

Safety devices have heretofore been devised for various reel and hoist devices, as for example the devices shown in U.S. Pat. Nos. 3,311,351; 3,160,360; 4,566,375; 4,625,933; and 4,722,422. However, none has been devised for regulated air pressure, ball screw operated balancing hoists of the type described.

Accordingly, the object of the present invention is to provide a simple yet effective safety device for preventing sudden over speeding of an air balancing hoist of the type using a ball screw arrangement for driving and holding a drum reel.

SUMMARY OF THE INVENTION

This object is accomplished by mounting a plurality of hydraulic piston and cylinder shock absorbers in the hoist housing, to extend axially symmetrically arranged about the ball nut axis, each shock absorber axially driven through an interposed thrust bearing by the end of the drum reel opposite that end engaged by the air pressure piston. The shock absorbers are able to be stroked by axial movement of the drum reel without significant resistance at the low speeds occurring during normal hoist operation, but generate considerable retarding force when higher speed motion occurs to prevent dangerously overspeeded wind up of the cable onto the drum reel.

A simple return spring is associated with each piston-cylinder shock absorber to keep the shock absorber ends in driving engagement with the drum reel end, but for a more compact design, a bias air pressure may be applied to the shock absorber pistons to eliminate the return springs and shorten the length required.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
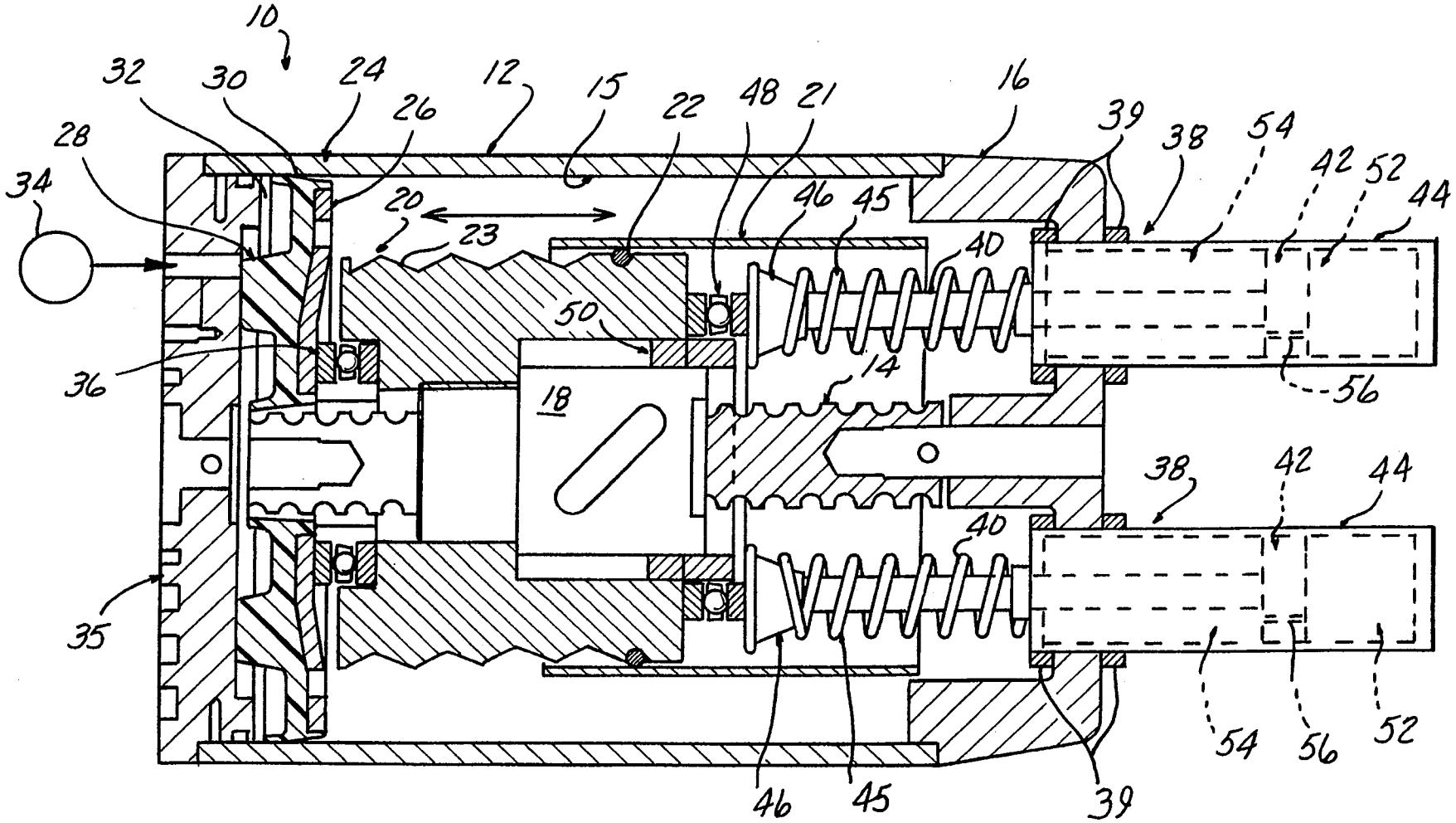
FIG. 1 is a partially sectional view of an air balancing hoist according to the present invention.

Referring to FIG. 1, the air balancing hoist 10 includes a generally cylindrical housing 12 supported so as to be prevented from rotating, typically by an attached trolley shoe running along an overhead rail (not shown) as described in U.S. Pat. No. 3,260,508.

A ball screw 14 is fixed at one end to the right cover 16 of the housing 12, projecting to the left across the interior bore 15 in the housing 12.

A recirculating ball nut 18 is received over the ball screw 14 fixed within a drum reel 20.

The drum reel 20 has a cable 22 attached at one end to be wound into a helical groove 23 formed into the exterior of the drum reel 20 as it is rotated by the ball nut 18.

A movable element here comprised of piston 24, is slidably received in the interior bore 15 of the housing 10, comprised of a metal disc 26 having a molded urethane plastic sealing part 28 bonded thereto. Sealing port 28 has a skirt portion 30 which sealingly engages the inside of the housing 12 to define a pressure chamber 32 to the left of piston 24 and the right of end cap 35, which chamber 32 is pressurized by a source of regulated air pressure 34.

The piston 24 drives the left end of the drum reel 20 by engagement with an interposed thrust bearing 36.

A cable confinement sleeve 21 is fixed to the end cap 16 and receives the drum reel 20 as it moves to the left in winding the cable 22, maintaining the cable 22 in the groove 23.

Thus, the weight of a load acting on the cable 22 tends to cause the nut 18 to rotate, reacting on the stationary ball screw 14 to drive the nut 18 and drum reel to the left. This tendency is countered by the force generated on the piston 24 by regulated air pressure in chamber 32.

As described in the above referenced patents, the regulated air pressure can be set to just balance the load, or to allow only a few pounds of the weight to be unbalanced, or to drive the piston 24 to raise the load with a controller device (not shown), in the manner well known in the art.

According to the concept of the invention, a plurality of piston and cylinder shock absorbers 38 are arranged about the axis of the ball screw 14, mounted by threaded rings 39 to end cap 16.

The plurality of shock absorbers 38 are arranged in symmetry about the ball screw axis so as not generate any tipping forces on the drum reel 20 or side loading of the shock absorbers 38 shock absorber 38 an of a type commercially available which preferably include an adjustable resistance feature. A currently available type is sold by Ace Controls, Inc., model CVC-4.

Each shock absorber 38 is shown in simplified form in FIG. 1 and includes a piston rod 40 attached to a piston 42 slidable in a housing 44, with return springs 45 urging the rods 40 to the left. Each piston rod 40 has an end piece 46 urged into engagement with portion of thrust bearing 48 by the return springs 45.

A thrust bearing 48 is seated against the opposite end of the drum reel 20 from that driven axially by the air piston 24, located concentrically with a centering collar 50 pressed onto the ball nut 18.

Rightward axial movement of the drum reel 20 thus forces the piston rods 40 to the right and forcing the pistons 42 to also be moved in the cylinders 44. This forces hydraulic fluid to be pumped from chamber 52 to chamber 54 defined in each of the cylinders 44 on either side of each of the pistons 42 passing through orifices 56. Orifices 56 are externally adjustable in the commercially available devices suitable for use with the invention.

At slow speeds occurring during normal operation, orifices 56 allow movement of the drum reel without significant resistance. At higher speeds, typical of those occurring if the load is dropped, the orifice 56 will restrict flow so that axial movement of the drum reel 20 is severely retarded. The resistance adjustment of the shock absorber allows matching of proper resistance to a particular range of loads to be encountered during use of the hoist.

Figure 2:
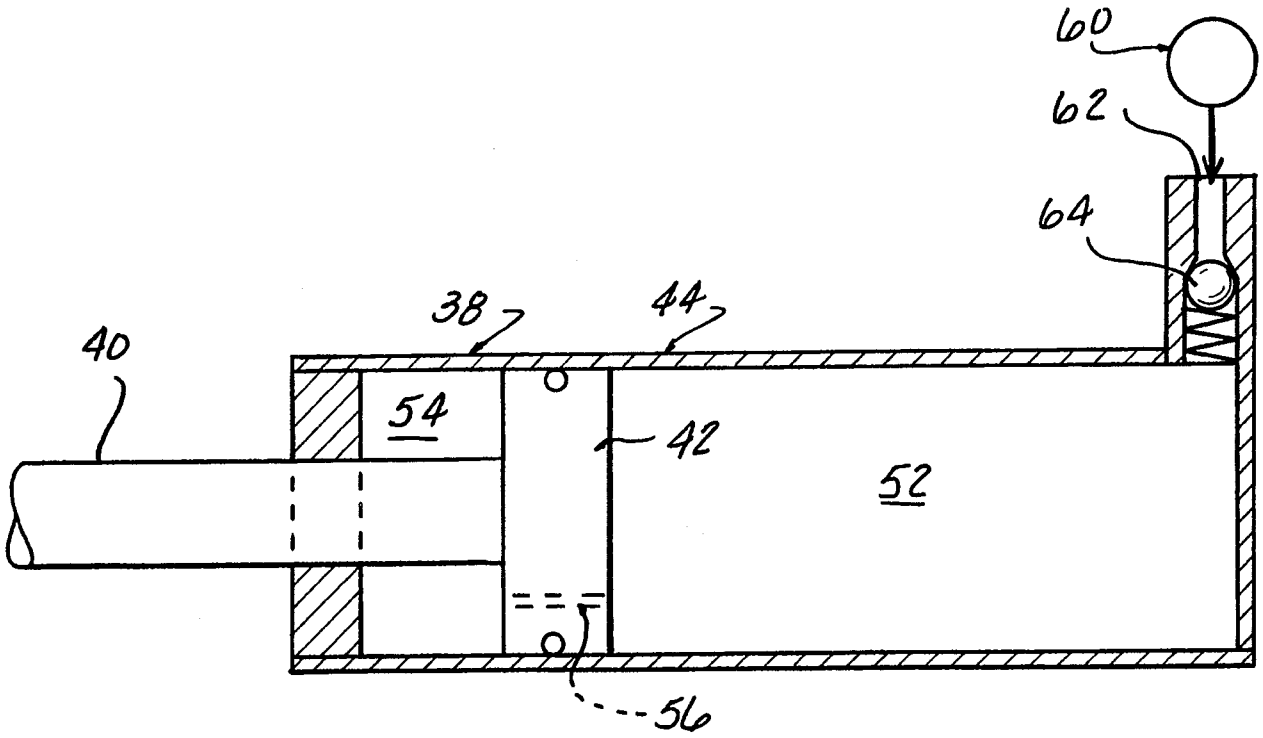
FIG. 2 is a sectional view of an alternate form of the shock absorber used in the air balancing hoist according to the present invention.

FIG. 2 shows an alternate arrangement for the return springs 45. This comprises pressurizing the interior of each cylinder 44 with air from a source 60 of compressed air connected to a port 62 opening into the interior of cylinder 44. A ball check valve 64 prevents the exit of any hydraulic fluid when the piston 42 is being stroked.

There is a difference in area on either side of the piston 42 subjected to hydraulic pressure due to the presence of the rod 40, and this difference creates a net pressure force greater on the right hand piston face urging the piston and rod 40 to the left to maintain driving engagement with the drum reel 20, thus providing the function of the return springs 45 in a more compact design.

I claim:

1. An air balancing hoist comprising:

a housing having an interior bore therein;

a ball screw mechanism mounted in said housing to extend axially through said interior bore;

said ball screw mechanism including a ball screw and a ball nut received over said ball screw;

a drum reel driven by said ball screw mechanism to be moved axially in said housing;

a cable attached to said drum reel so as to be wound thereon and unwound therefrom upon rotation of said drum reel in each respective axial direction;

a movable element axially movable in said housing interior bore and sealed therein to define a pressure chamber in said housing interior bore on one side of said movable element, the other side of said movable element driving one end of said drum reel to create an axial force acting thereon when said chamber is pressurized;

a source of regulated air pressure in communication with said chamber applying a pressure level sufficient to at least substantially balance an axial force exerted by said cable supporting a load acting through said balls crew mechanism to generate an axial force on said drum reel acting oppositely to said axial force generated by said regulated air pressure acting in said chamber;

at least one shock absorber comprising a piston mounted in a cylinder containing hydraulic fluid pumped from a chamber one side of said piston to a chamber on the other side through a restrictive passage upon movement of said piston in said cylinder, said shock absorber mounted in said housing so as to cause the piston of said shock absorber to be moved through said cylinder by axial movement of said drum reel in the direction urged by said air pressure in said chamber, said restrictive passage allowing substantially unrestricted flow therethrough at low flow rates caused by slow piston movements and thus unimpeded axial movement of said drum reel during normal winding and unwinding of said cable thereon but to substantially restrict flow at much higher flow rates caused by high speed piston movement so as to severely impede high speed movement of said drum reel corresponding to a condition wherein said load is suddenly lost.

2. The hoist according to claim 1 wherein there are a plurality of said shock absorbers arranged about said ball screw axis, each extending axially in said housing.

3. The hoist according to claim 2 wherein said shock absorbers are symmetrically arranged about said ball screw axis.

4. The hoist according to claim 3 wherein each of said shock absorbers includes bias means constantly urging each of said piston rods into driving engagement with said drum reel.

5. The hoist according to claim 2 wherein said shock absorbers each include a piston rod attached to said piston, each piston rod drivingly engaged with the other end of said drum reel opposite said one end drivingly engaged with said movable element.

6. The hoist according to claim 5 wherein said bias means includes a return spring acting on each piston rod.

7. The hoist according to claim 5 wherein said bias means includes means applying a constant air pressure within each shock absorber cylinder.

8. The hoist according to claim 7 wherein said bias means includes a cylinder port for introducing air pressure and further includes a check valve preventing escape of hydraulic fluid from said port.

9. The hoist according to claim 5 further including a thrust bearing interposed between said piston rods and said drum reel.

* * * * *

UNITED STATES PATENT AND TRADEMARK OFFICE

CERTIFICATE OF CORRECTION

PATENT NO. : 5,370,367

DATED : December 6, 1994

INVENTOR(S) : James Zaguroli, Jr.

It is certified that error appears in the above-identified patent and that said Letters Patent is hereby corrected as shown below:

Claim 1, Column 4, line 5, "crew" should be --screw--.

Signed and Sealed this

Eighteenth Day of April, 1995

Bruce Lehman

*Attest:*

BRUCE LEHMAN

*Commissioner of Patents and Trademarks*

*Attesting Officer*